United States Patent [19]

Ofield et al.

[11] 4,430,521

[45] Feb. 7, 1984

[54] OPTIONAL REAR ENTRY BACK CONNECTOR FOR A BASEBOARD HEATER

[75] Inventors: L. Ronald Ofield, Islington; Leonhard Puurits, Toronto; Roy A. Patterson, Mississauga, all of Canada

[73] Assignee: Westcan Electrical Manufacturing Inc., Brantford, Canada

[21] Appl. No.: 295,604

[22] Filed: Aug. 24, 1981

[30] Foreign Application Priority Data

Oct. 10, 1980 [CA] Canada ..... 362241

[51] Int. Cl.[3] ..... F24H 9/02

[52] U.S. Cl. ..... 174/65 R; 219/366

[58] Field of Search ..... 174/65 R, 67, 59; 219/342, 365, 366, 367, 368; 339/103 R

[56] References Cited

U.S. PATENT DOCUMENTS

| | | | |
|---|---|---|---|
| 1,901,943 | 3/1933 | Adell . | |
| 2,131,165 | 9/1938 | Clements | 247/9 |
| 2,667,368 | 1/1954 | Ferguson | 285/6.5 |
| 2,938,741 | 5/1960 | Lowery | 285/128 |
| 3,051,816 | 8/1962 | Knol et al. | 219/34 |
| 3,084,958 | 4/1963 | Appleton | 285/189 |
| 3,165,624 | 1/1965 | Cunningham | 219/365 |
| 3,211,889 | 10/1965 | McEachron | 219/345 |
| 3,410,582 | 11/1968 | Appleton | 285/128 |
| 3,417,192 | 12/1968 | Elm | 174/59 |
| 3,444,310 | 5/1969 | Stewart | 174/59 |
| 3,500,017 | 3/1970 | Zahaykevich | 219/366 |
| 3,600,008 | 8/1971 | Barry | 285/39 |
| 4,018,982 | 4/1977 | Svekis | 174/65 R |

*Primary Examiner*—A. C. Prescott
*Assistant Examiner*—D. A. Tone
*Attorney, Agent, or Firm*—Rogers, Bereskin & Parr

[57] ABSTRACT

The present invention provides an optional back connector assembly that is adapted for use with an elongated baseboard heating apparatus. The heating apparatus includes a removable knockout plate covering an aperture in the rear wall of the apparatus which plate when removed allows access through the aperture to a terminal section of the heating apparatus. The connector assembly comprises a bracket member having a mounting portion mounted to the rear wall within the terminal section below the aperture and a ramp supporting portion sloping upwardly and inwardly of the mounting portion to locate the ramp portion in proximity to the aperture. A clamping plate is further provided in the assembly which is operable for clamping between the ramp portion and the clamping plate at least one electrical power cable passing through the aperture into the terminal section. Lastly, the assembly includes a notched cover plate having at least one U-shaped notch along an edge surface of the cover plate. The cover plate is adapted to substantially cover the aperture so as to allow passage of the cable between the U-shaped notch and an edge surface of the rear wall.

12 Claims, 7 Drawing Figures

OPTIONAL REAR ENTRY BACK CONNECTOR FOR A BASEBOARD HEATER

The present invention relates to a heating apparatus. In particular, it relates to an optional back connector assembly adapted for use with the baseboard heating apparatus.

Electrical baseboard heaters incorporating a rear entry back connector to gain entry into the terminal section of the heater through the rear wall of the heater are becoming quite popular in the electrical industry.

One such rear entry back connector is disclosed in Canadian Pat. No. 849,656 which issued Aug. 18, 1970 to Federal Pacific Electric Company. The rear entry back connector disclosed in this patent includes a removable cover plate that covers an aperture in the rear wall of the baseboard heater. When the cover plate is removed, access may be gained through the aperture into the terminal section to make electrical connections between the leads of an electrical power cable and terminals located within the terminal section. The removable cover plate is further provided with a knockout which is removed to provide an aperture through which the electrical power cable passes. In order to prevent the power cable from moving through the aperture of the cover plate, a grommet surrounds the cable and is secured within the aperture. A disadvantage with this particular connector is that the grommet extends rearwardly of the rear wall of the baseboard heater. This makes the fitting of the baseboard heater against a flat wall virtually impossible.

In another rear entry back connector suitable for use with baseboard heaters is disclosed in Canadian Pat. No. 1,015,816 which issued Aug. 16, 1977 to Canadian Chromalox Company Limited. The rear entry back connector disclosed in this patent does not extend rearwardly of the rear wall of the heater and comprises a removable cover plate covering an aperture in the rear wall. The removable cover plate is provided with two apertures therein through which power cables may pass. A clamping plate is provided that clamps onto the cover plate so as to positively clamp the power cable in fixed relation to the cover plate.

One disadvantage common to both the above described rear entry back connectors is that the power cable is positively located in relation to the cover plate prior to the cover plate being secured to the rear wall of the baseboard heater. As a consequence, when the cover plate is replaced on the rear wall of the baseboard heater, the conductors tend to deform and randomly displace themselves within the terminal section. In some instances, the random displacement of the wire conductors results in the wire conductors touching the heating element connection. In such instances, the conductors have been known to electrically short circuit sometimes causing fires within the baseboard heater. Another disadvantage peculiar to the Chromalox rear entry device is that the internal flanges in the rear wall of the baseboard heater cannot be easily roll formed. Such flanges are necessary because the cover plate must be recessed to locate the cable and clamping plate inwardly of the flat rear wall and the recessed cover plate provides spaces through which access to the terminal connections could be gained if these spaces were not covered by the flanges. Another disadvantage with the Chromalox baseboard heater is that, in situations where an aperture is required at both ends of the baseboard heater, the stamping out of the cover plate and the cable clamp is necessitated at both ends of the baseboard heater thereby resulting in increased material costs.

It is therefore a feature of the present invention to provide a back connector assembly which is adapted for use with a baseboard heater which is not subject to the disadvantage of random displacement of the wire conductors within the terminal section of the heater.

It is another feature of the present invention to provide an optional back connector assembly that is adapted for use with a baseboard heater and minimize the material cost involved in providing such a back connector.

Briefly, the present invention provides a back connector assembly adapted for use with an electrical baseboard heating apparatus. The heating apparatus has a terminal section, a rear wall and an aperture in the rear wall which permits access to the terminal section. The back connector assembly comprises a bracket member which may be positioned within the terminal section. The bracket member has a supporting portion which is located in proximity to the aperture of the rear wall. A clamping plate is provided for clamping between the clamping plate and the supporting portion of the bracket member an electrical power cable. The power cable passes through the aperture into the terminal section and is positively located between the clamping plate and the supporting portion. The assembly further provides a notched cover plate which is adapted to substantially cover the aperture and to allow passage of the cable between edge surfaces of the cover plate and the rear wall. Advantage is found in the present invention because the clamping plate and the supporting portion, by clamping the power cable therebetween, positively locate the cable within the terminal section prior to the cover plate covering the aperture. Once the power cable is positively located within the terminal section, conductors of the power cable may be dressed (positioned) within the terminal section remote of the heating element connection.

The present invention may further provide for the baseboard heating apparatus to be provided with a removable plate covering the aperture whereby removal of the removable plate permits access to the terminal section of the heating apparatus. Such a removable plate makes the utilization of the back connector optional in the baseboard heating apparatus. It should be understood that the rear entry back connector is utilized only when a power cable passes through the wall to which the baseboard heater lies. In many instances the power cable may pass through the floor and the bottom wall of the baseboard heater. Thus entry through the rear wall of the baseboard heater is not mandatory. Moreover, in some instances it is desirable to provide two terminal sections at opposing ends of the baseboard heating apparatus even though all the connections will be made in only one of the terminal sections. The present invention finds advantage in these latter instances because only the notched cover plate and clamping plate need be provided thereby reducing the material cost.

In some applications of the invention, it is contemplated that the removable cover plate may comprise a knockout formed in the rear wall of the baseboard heating apparatus. Also the notched cover plate may simply cover the aperture and overlay the rear wall. Hence, the present invention finds advantage in the case of baseboard heaters that are roll formed because additional flanges inturned around the aperture in the rear wall need not be provided because there are no large spaces which permit access to the terminal connections within the terminal section once the notched cover plate is positioned to cover the aperture.

In accordance with a broad aspect of the invention there is provided a back connector assembly adapted for use with an electrical heating apparatus having a terminal section, a rear wall and an aperture in the rear wall permitting access to the terminal section. The assembly comprises: a bracket member positionable within the terminal section to locate a supporting portion thereof in proximity to the aperture, a clamping plate operable for clamping between the supporting portion and the clamping plate an electrical power cable passing through the aperture into the terminal section, and a notched cover plate adapted to substantially cover the aperture to allow passage of the cable between edge surfaces of the cover plate and the rear wall.

For a better understanding of the nature and objects of the present invention, reference may be had by way of example to the accompanying diagrammatic drawings of the preferred embodiment of the instant invention:

Referring to FIGS. 1 through 7 the preferred embodiment of the present invention is described.

Figures 1, 2, 3:
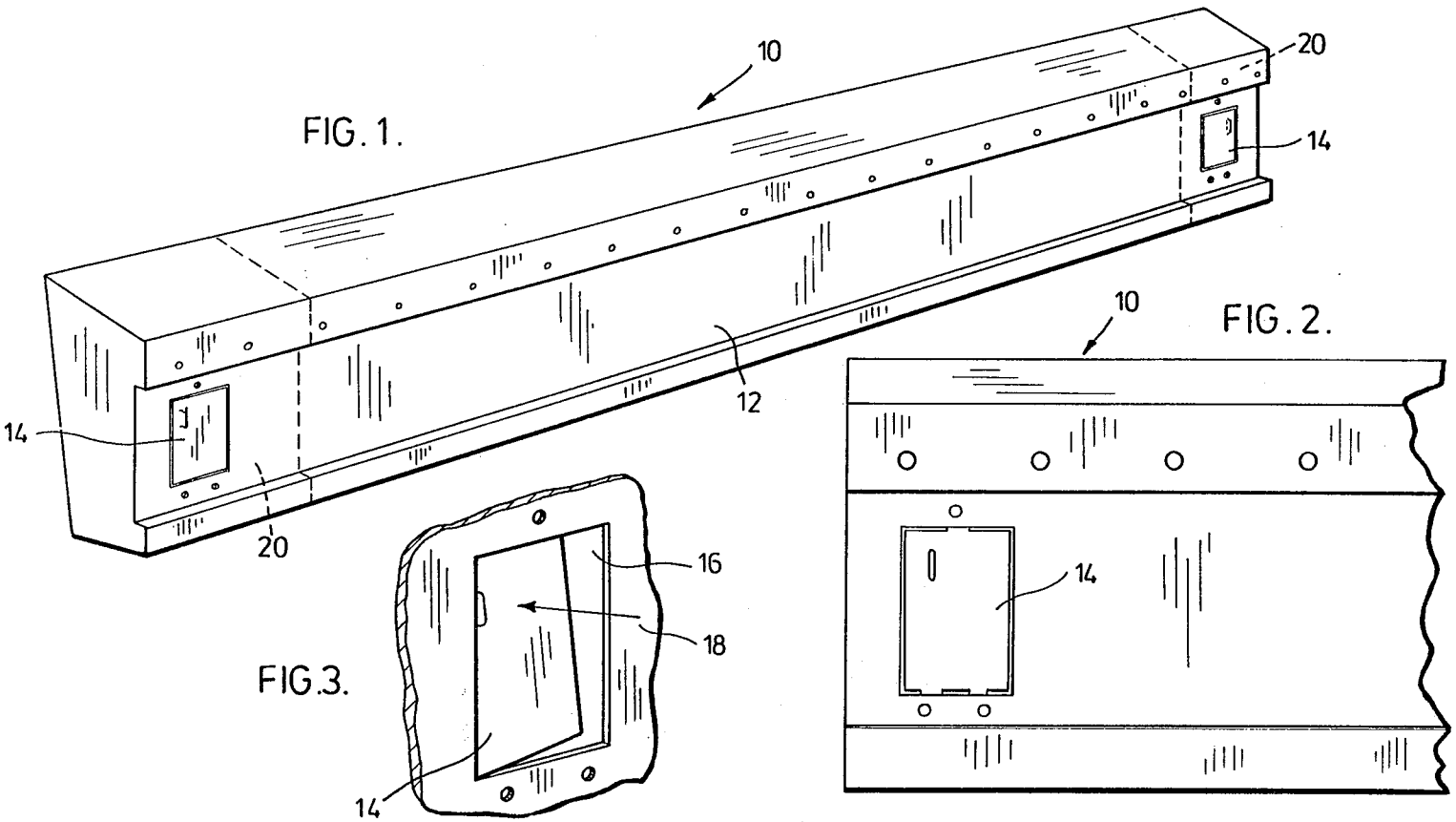
FIG. 1 is a rear perspective view of the baseboard heating apparatus utilized in the present invention.
FIG. 2 is a rear plan view of an end section of the baseboard heating apparatus.
FIG. 3 is a view showing the removable cover plate of the baseboard heating apparatus being partially removed from the aperture of the heating apparatus.
Figure 4:
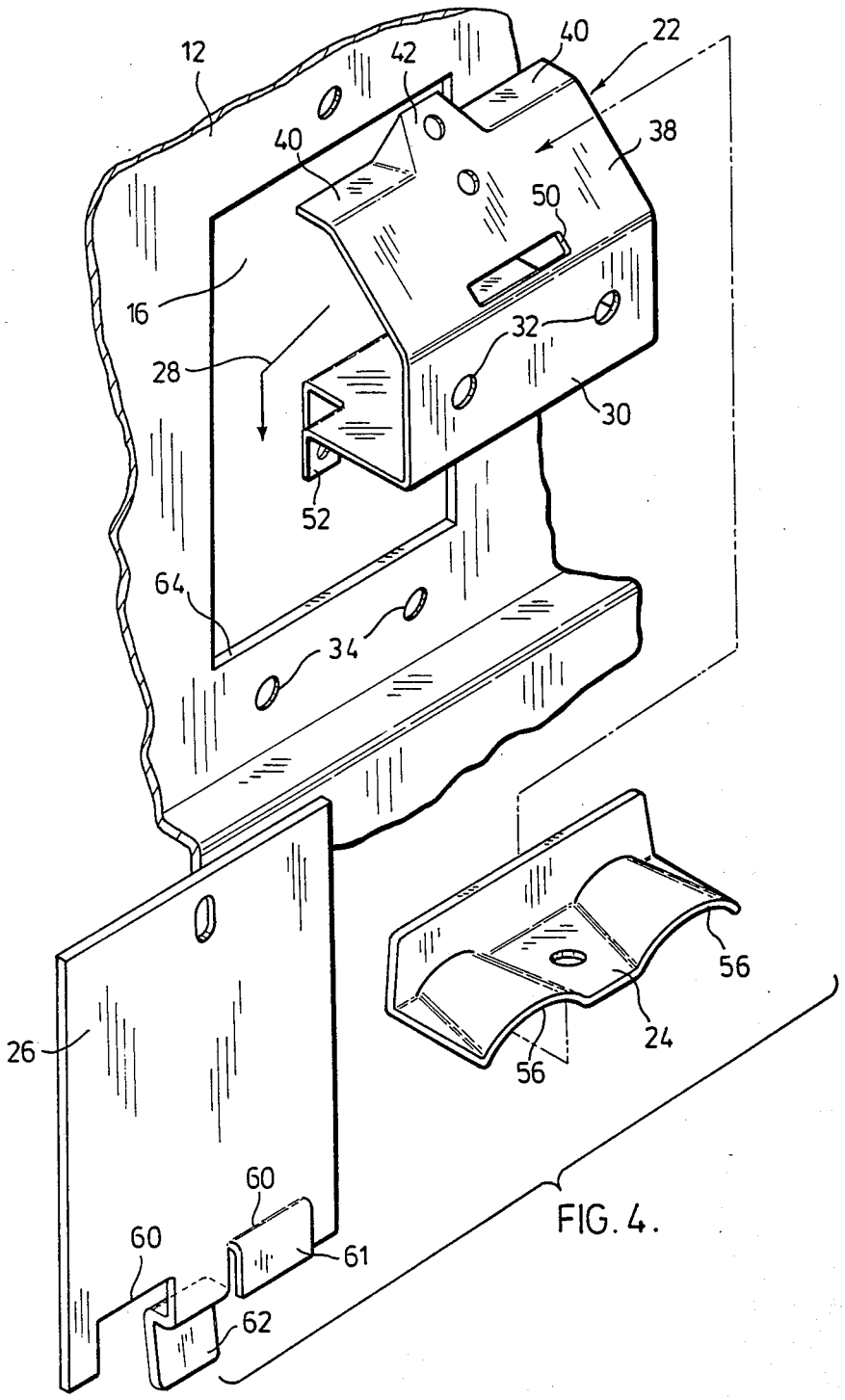
FIG. 4 is an exploded perspective view of the optional back connector for the baseboard heating apparatus.
Figure 5:
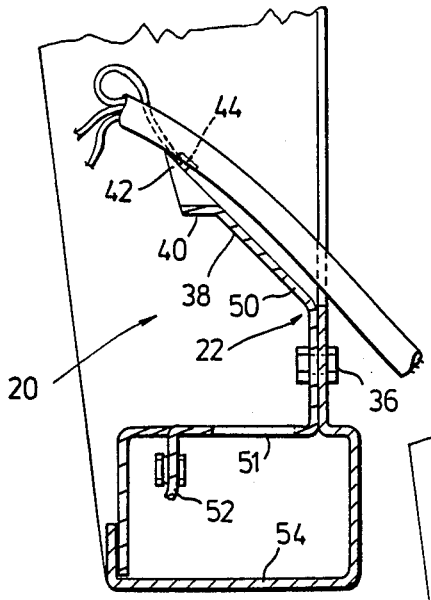
FIG. 5 is a plan sectional side view showing the bracket member assembled within the terminal section of the baseboard heater.

The baseboard heating apparatus or heater 10 utilized in the present invention is shown in FIGS. 1 through 3 to comprise a rear wall 12 having a removable cover plate 14 covering an aperture 16. The removable cover plate 14 comprises a knockout which may be knocked into the heater 10 either by a screwdriver or hammer as shown in FIG. 3 by arrow 18. A removable cover plate 14 is provided at opposing ends of the baseboard heater 10. Once the cover 14 is removed, access may be gained through aperture 16 into a respective terminal section 20 of the baseboard heater 10.

Referring to FIGS. 4 through 7 the optional back connector assembly of the present invention is shown to comprise a bracket member 22, a clamping plate 24 and a notched cover plate 26. The bracket member 22 is positionable within the terminal section 20 of the baseboard heater 10 as shown by arrow 28 in FIG. 4. The bracket member 22 includes a mounting portion 30 having apertures 32. Mounting portion 30 lies flush against the inner surface of rear wall 12 such that apertures 32 are aligned with apertures 34 in the rear wall 12. Suitable fastening means 36 such as, for example, rivets, mount the mounting portion 30 of bracket 22 to the rear wall 12 such that a ramp support portion 38 of bracket member 22 slopes inwardly and upwardly of the rear wall 12 and mounting portion 30. The bracket member 22 is thus positioned within the terminal section to locate the ramp portion 38 in proximity to the aperture 16. The ramp supporting portion 38 of the bracket member terminates in two bent over tab portions 40 which define a nose 42 therebetween. Nose 42 is a continuum of ramp surface portion 38. The nose 42 of bracket member 22 is provided with an aperture to receive a ground screw 44 (see FIG. 6) which acts to ground a ground conductor 46 of an electrical power cable 48. The ramp supporting portion 38 of bracket member 22 is further provided with an elongated slot 50, the purpose of which will be described later. The bracket member 22 is further provided with an aperture 51 in a lower portion thereof and a downturned grounding tab connector 52. The connector 52 and aperture 51 are provided in the instances where the power cable passes through the floor and lower wall 54 of the baseboard heater 10.

It should be understood that in this preferred embodiment a bracket member 22 is positioned within each terminal section 20 of the baseboard heater prior to the removable cover plate 14 being removed. That is to say the bracket member is assembled within each terminal section 20 during the assembly of heater 10. However, it should be understood that, if so desired,, the bracket members 22 need not be pre-assembled within the terminal sections 20.

Figure 6:
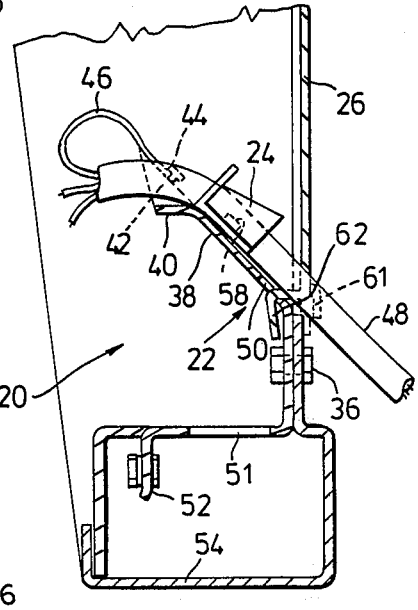
FIG. 6 is a side sectional view showing the back connector assembly assembled with respect to the baseboard heater; and, FIG. 7 is a rear perspective partial view showing the notched cover plate covering the aperture of the baseboard heating apparatus.

The optional back connector assembly further comprises a cable clamping plate 24 which clamps between one of its grooves 56 and the ramp supporting portion 38 of bracket member 22 the electrical power cable 48 (see FIG. 6). The clamping plate 24 and ramp portion 38 of bracket 22 are each provided with an aperture therein through which suitable fastening means such as, for example, screw 58 may pass.

Figure 7:
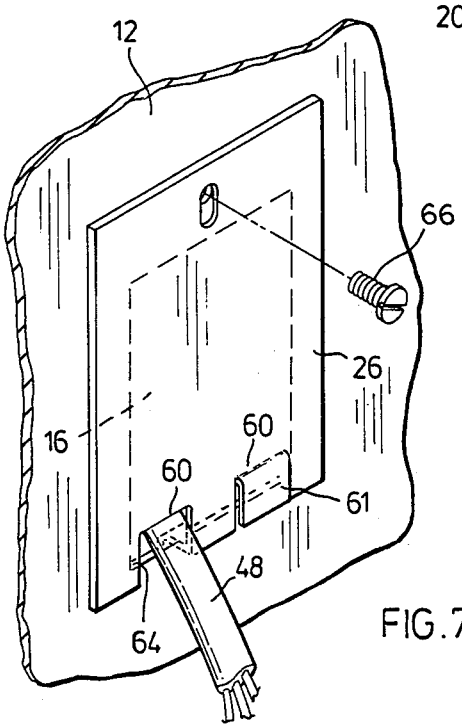

The optional back connector assembly is further provided with a notched cover plate 26 having U-shaped notches 60 along an edge surface thereof. The cover plate has a downwardly depending tab portion 62 which is adapted to pass through slotted aperture 50 of bracket 22 when the cover plate covers aperture 16. Cover plate 26 includes a removable knockout 61 which covers one of the U-shaped notches. Cover plate 26 is further provided with an aperture in the top portion thereof which aligns with an aperture in the rear wall 12 above aperture 16 to permit the passage of screw 66 therethrough so as to secure the cover plate 26 to rear wall 12. As shown in FIG. 7, power cable 48 may pass between the U-shaped notches 60 of cover plate 26 and edge surface 64 of rear wall 12.

Perhaps for a better understanding of the nature and object of the present invention a brief description of how the invention may be used in a baseboard heater will now follow. It is contemplated that an electrician will receive a baseboard heater 10 substantially as shown in FIG. 1 with the bracket member 22 pre-assembled within each terminal section 20. The electrician will also receive one clamping plate 24 and one cover plate 26. Should the situation arise where the power cable is to pass through a wall against which the baseboard heater will lay, then connections to the terminal section 20 of the baseboard heater 10 may be made through the rear entry back connector of the present invention. One of the removable plates 14 is removed by knocking the plate inwardly with a hammer and removing the plate from the terminal section 20 of the heater 10. Suitable lengths of insulation from conductors of the power cable may then be stripped. The stripped conductors may then be connected to the appropriate terminals within the terminal section of the baseboard heater by using the access provided by aperture 16. Once the connections are made, the power cable may be bent over one of the tab portions 40 of bracket member 22 and while holding the cable in position, clamping plate 24 may be positioned and secured thereover to clamp the power cable between clamping plate 24 and ramp support portion 38 of bracket member 22. At this time the electrician may reach into the terminal section of the baseboard heater and dress the insulated conductors away from the heating element terminal thereby ensuring that such conductors do not come into contact with the heating element terminal. The electrician may then readily take cover plate 26 and slip tab portion 62 thereof into slot 50 of the bracket member 22 and proceed to secure screw 66 into place between the aligned apertures of cover plate 26 and rear wall 12 so as to secure the cover plate 26 to the rear wall 12. Should the electrician desire to use a second power cable then such a cable can be attached in a similar manner as described above, and to accommodate the second cable the knockout 61 can be removed.

It should be understood that in the event that one opening is still provided between the edge surface 64 of wall 12 and the notch 60, access to the terminal connections within the terminal section 20 may not be effected because a probe entering such an aperture would be impeded by ramp portion 38 of bracket member 22 and knockout 61.

It should be understood that the foregoing has been a description of the preferred embodiment for the present invention and that alternate embodiments may be readily apparent therefrom to a man skilled in the art. Accordingly, the present invention should only be limited to that which is claimed in the accompanying claims.

What I claim as new and desire to secure by Letters Patent of the United States is:

1. In combination with an electrical heating apparatus having an enclosed terminal section, a rear wall and an aperture in said rear wall permitting access to said terminal section; a back connector assembly comprising: a bracket member including a supporting portion and secured within said terminal section to locate the supporting portion in proximity to said aperture, the bracket member and the aperture being so dimensioned so as to leave a substantial part of the aperture unobstructed, an electrical power cable passing over the bracket member, through the aperture and into the terminal section; a clamping plate clamping said cable between said supporting portion and said clamping plate, said unobstructed part of said aperture permitting access therethrough to an end of the electric power cable within the terminal section and a notched cover plate covering substantially said aperture and allowing passage of said cable between edge surfaces of said cover plate and said rear wall.

2. The assembly of claim 1 wherein said supporting portion slopes upwardly and inwardly of said rear wall.

3. The assembly of claim 1 wherein said bracket member is secured to the rear wall of said apparatus.

4. The assembly of claim 3 wherein said bracket member includes a mounting portion lying flush against said rear wall and mounted thereto below said aperture.

5. The assembly of claim 4 wherein said supporting portion of said bracket member slopes upwardly and inwardly of said mounting portion.

6. The assembly of claim 5 wherein said supporting portion terminates in two bent-over tab portions which define a nose portion therebetween which is a continuum of said supporting portion.

7. The assembly of claim 6 wherein said nose portion has an aperture therein for receiving a ground screw to which a grounding conductor of said power cable may be secured.

8. The assembly of claim 1 wherein said bracket member has a receiving slot which receives a tab portion of said notched cover plate.

9. The assembly of claim 8 wherein said cover plate is adapted to be secured to said rear wall.

10. An assembly as claimed in claim 1, wherein the notched cover plate has an edge surface and at least one U-shaped notch along the edge surface, and wherein the aperture is bound by an edge surface of the rear wall with the electrical power cable passing between the U-shaped notch and the edge surface of the rear wall.

11. An assembly as claimed in claim 1, wherein the electrical heating apparatus is elongate and comprises a baseboard heating apparatus adapted for mounting on a baseboard, and wherein the terminal section, the aperture and the back connector assembly are located at one end of the apparatus.

12. The assembly of claim 11, which further includes a second aperture, and a second terminal section both of which are located at an opposite end of the apparatus from said one end, said assembly further including a second bracket member located within the second terminal section, and a second clamping plate and a second notched cover plate being adapted for use with said second bracket member and said second aperture.

* * * * *